US006848363B2

(12) United States Patent
Becker

(10) Patent No.: US 6,848,363 B2
(45) Date of Patent: Feb. 1, 2005

(54) DEVICE FOR CHANGING THE OPERATING STATE OF A GRIPPER-CONTROL DEVICE IN A SHEET-REVERSING DEVICE OF A SHEET-PROCESSING MACHINE AND SHEET-PROCESSING MACHINE HAVING THE DEVICE

(75) Inventor: Willi Becker, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 99 days.

(21) Appl. No.: 10/317,934

(22) Filed: Dec. 12, 2002

(65) Prior Publication Data

US 2003/0106446 A1 Jun. 12, 2003

(30) Foreign Application Priority Data

Dec. 12, 2001 (DE) ..... 101 61 083

(51) Int. Cl.[7] ..... B41F 21/10

(52) U.S. Cl. ..... 101/222; 101/230; 101/231; 101/179; 101/409; 101/410; 271/225

(58) Field of Search ..... 101/230, 222, 101/223, 231, 183, 179, 180, 408, 409, 410; 271/225, 902

(56) References Cited

U.S. PATENT DOCUMENTS

| | | | | |
|---|---|---|---|---|
| 3,829,084 A | | 8/1974 | Jurny | |
| 4,563,951 A | | 1/1986 | Mathes et al. | |
| 4,821,643 A | | 4/1989 | Wieland | |
| 5,076,164 A | | 12/1991 | Becker | |
| 5,213,035 A | | 5/1993 | Becker | |
| 5,249,521 A | * | 10/1993 | Kobler | 101/230 |
| 5,265,528 A | * | 11/1993 | Mathes | 101/183 |
| 5,365,846 A | | 11/1994 | Becker | |

FOREIGN PATENT DOCUMENTS

| | | |
|---|---|---|
| DE | 22 27 151 B2 | 1/1973 |
| DE | 31 36 349 C2 | 8/1982 |
| DE | 34 10 689 C2 | 10/1985 |
| DE | 37 38 674 C2 | 4/1989 |
| DE | 39 11 609 C2 | 10/1990 |
| DE | 41 31 273 C1 | 12/1992 |
| DE | 42 31 257 C2 | 3/1994 |

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Gregory L. Mayback

(57) ABSTRACT

A device for changing an operating state of a gripper-control device in a sheet-reversing device of a sheet-processing machine including a cylinder having an actuating shaft accommodated therein, includes an activating element cooperatively engaging with the actuating shaft for changing the operating state of the gripper control device. An actuating element is coupled mechanically with the actuating shaft. An adjusting element is movable relative to the cylinder. The adjusting element is disposed externally to the cylinder and cooperatively engages with the actuating element for moving the actuating element at least approximately synchronously with the cylinder during operation of the sheet-processing machine while the actuating shaft remains in a prescribed position with respect to the cylinder. The actuating element is changeable in position relative to the cylinder by the adjusting element, whenever the operating state is changed. A sheet-processing machine is provided with the operating-state changing device.

16 Claims, 13 Drawing Sheets

DEVICE FOR CHANGING THE OPERATING STATE OF A GRIPPER-CONTROL DEVICE IN A SHEET-REVERSING DEVICE OF A SHEET-PROCESSING MACHINE AND SHEET-PROCESSING MACHINE HAVING THE DEVICE

BACKGROUND OF THE INVENTION

Field of the Invention

The invention relates to a device for changing the operating state of a gripper-control device in a sheet-reversing device of a sheet-processing machine. The invention also relates to a sheet-processing machine having the operating state changing device.

In sheet-fed rotary printing machines, paper sheets which are to be printed are removed from a sheet pile and transported through individual printing units of the printing machine with the aid of grippers, which are accommodated on cylinders of the printing machine. In order to allow the sheets to be printed both on the upper side and on the underside thereof, sheet-fed printing machines are provided, in a heretofore known manner, with reversing or turning devices which are disposed, for example in the form of a reversing or turning drum, between two printing units of the printing machine. The reversing drum, in that regard, has a plurality of suction grippers by which the sheets that have been printed on one side and are guided on an upstream impression cylinder, are gripped at a trailing edge thereof, lifted from the circumferential surface of the impression cylinder and transferred to one or more pincer grippers or reversing grippers disposed in the interior of the reversing drum, and transfer the trailing sheet edge as a new leading edge to the gripper device of the impression cylinder of a downstream printing unit, wherein the sheet is printed on the reverse side thereof.

In the case of the aforedescribed reversing or turning device, in order to switch over or convert between the operating state of single-side printing, wherein the sheets are printed on one side, and the operating state of first form and perfector printing, wherein each of the sheets is printed on both sides thereof, it is necessary to activate reversing or turning grippers and/or suction grippers gripping the trailing sheet edge. That is accomplished, in a conventional manner, by actuating shafts which cooperate with activating elements by which the cam followers of the gripper-control devices, that are fixed by the activating elements during single-side printing, are released in order to activate the grippers. As a result, during the subsequent first-form and perfecting operation, the grippers are activated via the cam followers running along the associated gripper-control cams. In order to ensure further that, during the changeover between the operation of single-side printing and the first-form and perfector printing operation, the gripper devices are located in the correct position for gripping the trailing sheet edge, with the heretofore known reversing or turning devices, the gear train for driving the cylinders disposed upstream of the reversing or turning device is coupled via a clamping coupling, which is disposed on the reversing or turning device, to the gear train for driving the cylinders which are disposed downstream of the reversing or turning device. In order to perform the changeover or conversion between the single-side printing operation and the first-form and perfector printing operation, the coupling therein is opened and the gear train of the downstream printing units are rotated in relation to the gear train of the upstream printing units until such time as the gripper devices have assumed the correct position for the respective sheet format. The coupling is then closed, and printing is continued in the newly set operating state.

German Patent DE 39 11 609 C2, corresponding to U.S. Pat. No. 5,076,164, discloses, in that context, the performance of activating and deactivating the gripper devices for gripping the trailing sheet edge in a reversing or turning operation with the aid of an actuating shaft which acts, via an activating element, on the gripper shaft in order to secure the latter and/or which, via a correspondingly configured activating element, brings the cam follower into engagement with differently configured gripper-control cams in order to open and close the gripper device. In the described device, the coupling for disconnecting the gear trains is disposed directly on the side of the reversing or turning drum and, as is generally customary, is formed by a fixed gearwheel, which is disposed coaxially with the reversing or turning drum and fastened on the latter, and an adjusting gearwheel, which has an annular construction, extending coaxially with the fixed gearwheel and, in order to close the coupling, is pressed axially against the side wall of the fixed gearwheel by a pressure-exerting element. In order to achieve automatic adjustment of the gripper device during format adjustment or when the operating state is changed, the actuating shaft, in the described device, is guided through a slot formed in the pressure-exerting element and is rotated via an adjusting element in the form of a toothed segment, which cooperates in a complex manner with the adjusting gearwheel, as well as a pinion, which is coupled to the actuating shaft. Apart from the mechanically very complex mechanism, the described device is beset by the problem that the strength or rigidity of the pressure-exerting element is vastly reduced as a consequence of forming the slot in the actuating shaft. Moreover, it is not possible, with the described device, for the actuating shaft to be disposed on a cylinder which is not provided with a coupling for disconnecting the gear trains.

Furthermore, it has become known heretofore from German Patent DE 42 31 257 C2, corresponding to U.S. Pat. No. 5,365,846, to provide two cylinders in a reversing or turning drum of a sheet-fed rotary printing machine, which are coupled with one another drivewise via intermediate gearwheels revolving at an increased speed. In that regard, one of the intermediate gearwheels is constructed as a double intermediate gearwheel with two coaxially disposed individual gearwheels. One of the gearwheels engages with the driving gearwheel of a downstream printing unit, and the other engages with the gear train of the upstream printing units.

SUMMARY OF THE INVENTION

It is accordingly an object of the invention to provide a device for changing the operating state of a gripper-control device in a sheet-reversing or sheet-turning device of a sheet-processing machine and a sheet-processing machine having the operating state changing device, in which the operating state changing device has a straightforward construction and which, when the operating state of the printing machine is changed, in particular during the switchover or conversion between a single-side printing operation and a first-form and perfector printing operation, allows the operating state of the gripper-control device to be changed automatically.

With the foregoing and other objects in view, there is provided, in accordance with the invention, a device for changing the operating state of a gripper-control device in a sheet-reversing device of a sheet-processing machine. The sheet-reversing device includes a cylinder having an actuating shaft accommodated therein and the operating state changing device comprises an activating element cooperatively engaging with the actuating shaft for changing the operating state of the gripper control device. An actuating element is coupled mechanically with the actuating shaft. An adjusting element which is movable relative to the cylinder is disposed externally to the cylinder and cooperatively engages with the actuating element for moving the actuating element at least approximately synchronously with the cylinder during operation of the sheet-processing machine while the actuating shaft remains in a prescribed position with respect to the cylinder. The adjusting element serves for changing the position of the actuating element relative to the cylinder whenever the operating state is changed.

In accordance with another feature of the invention, the actuating shaft is rotatably mounted coaxially with the axis of rotation of the cylinder. The actuating element and the adjusting element are respectively formed by a first and a second mutually meshing gearwheel. The first gearwheel is connected to the actuating shaft, and the second gearwheel is in drive connection with a further cylinder of the sheet-processing machine.

In accordance with a further feature of the invention, the second gearwheel is disposed coaxially with the further cylinder and is connected thereto so as to be fixed against rotation relative thereto.

In accordance with an added feature of the invention, the first gearwheel and the second gearwheel are disposed on the operator side of the sheet-processing machine.

In accordance with an additional feature of the invention, the first-mentioned cylinder and the further cylinder are coupled with one another via a gear train having a double gearwheel including a fixed gearwheel in drive connection with the further cylinder, and an adjusting gearwheel coupled with the fixed gearwheel for forming a coupling. The coupling, when open, is rotatable relative to the fixed gearwheel for changing the mode of operation and/or adapting to different sheet formats.

In accordance with yet another feature of the invention, the fixed gearwheel is disposed coaxially with the further cylinder and is connected thereto so as to be fixed against rotation relative thereto. The second gearwheel is disposed coaxially with the fixed gearwheel and is connected thereto so as to be fixed against rotation relative thereto.

In accordance with yet a further feature of the invention, the double gearwheel is constructed as a double intermediate gearwheel revolvable at a greater speed than that of the cylinder. The double intermediate gearwheel is in drive connection with a driving gearwheel of the further cylinder via a further intermediate gearwheel. The second gearwheel is disposed coaxially with the fixed gearwheel of the double intermediate gearwheel and is connected thereto so as to be fixed against rotation relative thereto.

In accordance with yet an added feature of the invention, the actuating shaft is rotatably mounted coaxially with the axis of rotation of the cylinder. A tensioning gear mechanism includes the actuating element and the adjusting element. The actuating shaft is drivable via the tensioning gear mechanism by a further cylinder of the printing machine. The actuating element is formed by a first belt pulley connected to the actuating shaft or a first chain wheel. The adjusting element is formed by a second belt pulley that is in drive connection with the second cylinder or a second chain wheel.

In accordance with yet an additional feature of the invention, the one of the second belt pulley and the second chain wheel is disposed coaxially with a cylinder disposed directly upstream of the further cylinder and is connected thereto so as to be fixed against rotation relative thereto.

In accordance with still another feature of the invention, the tensioning gear mechanism is disposed on the operator side of the sheet-processing machine.

In accordance with still a further feature of the invention, the first-mentioned cylinder and the further cylinder are coupled with one another via a gear train having a double gearwheel including a fixed gear wheel in drive connection with the further cylinder and an adjusting gearwheel coupled with the fixed gearwheel for forming a coupling. The coupling, when open, is rotatable with respect to the fixed gearwheel for changing the operating mode or the adaptation to different sheet formats. The double gearwheel is constructed as a double intermediate gearwheel revolvable at a greater speed than that of the first-mentioned cylinder and is in drive connection with the driving gearwheel of the further cylinder via a further intermediate gearwheel. The second belt pulley or the second chain wheel is disposed coaxially with the further intermediate gearwheel and is connected thereto so as to be fixed against rotation relative thereto.

In accordance with still an added feature of the invention, changing the operating state of the gripper control device constitutes switching the gripper-control device over between single-side printing and first form and perfector printing. The actuating shaft is supported relative to the cylinder via a thread for producing an axial movement of the actuating shaft when the actuating shaft is rotated relative to the cylinder. The activating element includes a lever for transmitting the axial movement of the actuating shaft to the gripper-control device to switch the gripper-control device over between single-side printing or first form and perfector printing operating states. The gripper-control device is adapted for different sheet formats.

In accordance with still an additional feature of the invention, the cylinder is the reversing drum of the sheet-reversing device.

In accordance with another feature of the invention, the further cylinder is an impression cylinder of the sheet-processing machine. The impression cylinder is disposed upstream of the sheet-reversing device.

In accordance with a further feature of the invention, the adjusting element is in permanent engagement with the actuating element.

In accordance with an added feature of the invention, changing the operating state of the gripper control device constitutes switching the gripper-control device over between single-side printing and first form and perfector printing.

With the objects of the invention in view, there is also provided a sheet-processing machine, comprising a device for changing the operating state of a gripper-control device in a sheet-reversing device of the sheet-processing machine. The sheet-reversing device includes a cylinder having an actuating shaft accommodated therein and the operating state changing device includes an activating element cooperatively engaging with the actuating shaft for changing the operating state of the gripper control device. An actuating element which is coupled mechanically with the actuating shaft is movable relative to the cylinder. The adjusting element is disposed externally to the cylinder and cooperatively engages with the actuating element for moving the actuating element at least approximately synchronously with the cylinder during operation of the sheet-processing machine while the actuating shaft remains in a prescribed position with respect to the cylinder. The adjusting element serves for changing the position of the actuating element relative to the cylinder whenever the operating state is changed.

In accordance with a concomitant feature of the invention, the sheet-fed processing machine is a sheet-fed rotary printing press.

The operating-state changing device according to the invention offers the advantage that the coupling for the purpose of decoupling the gear train of the printing unit disposed upstream of the reversing or turning device from the gear train of the printing units disposed downstream of the reversing or turning device need not necessarily be disposed on the reversing or turning drum in order to allow an automatic changeover, advancement or withdrawal of the gripper-control device when one gear train is rotated in relation to the other gear train.

Furthermore, the operating-state changing device according to the invention offers the advantage that it is very compact and is constructed from only a small number of components which are relatively simple and cost-effective to produce. Furthermore, there is no need for any additional couplings or individual clamping devices in the reversing or turning drum, as are necessary, for example, in the case of corresponding devices of the prior art.

Additionally, due to the numerous possible variations upon which the principle according to the invention is based, the operating-state changing device according to the invention is able to be adapted optimally to the installation space that is available and to other conditions in a sheet-processing machine. It is thus possible, for example, in the case of the actuating shaft being driven via a tensioning gear mechanism, for the installation space available in the region of the reversing or turning drum to be filled with other components, for example with components of a coupling for decoupling the gear train during format changeover.

Other features which are considered as characteristic for the invention are set forth in the appended claims.

Although the invention is illustrated and described herein as embodied in a device for changing the operating state of a gripper-control device in a sheet-reversing device of a sheet-processing machine and a sheet-processing machine having the operating state changing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
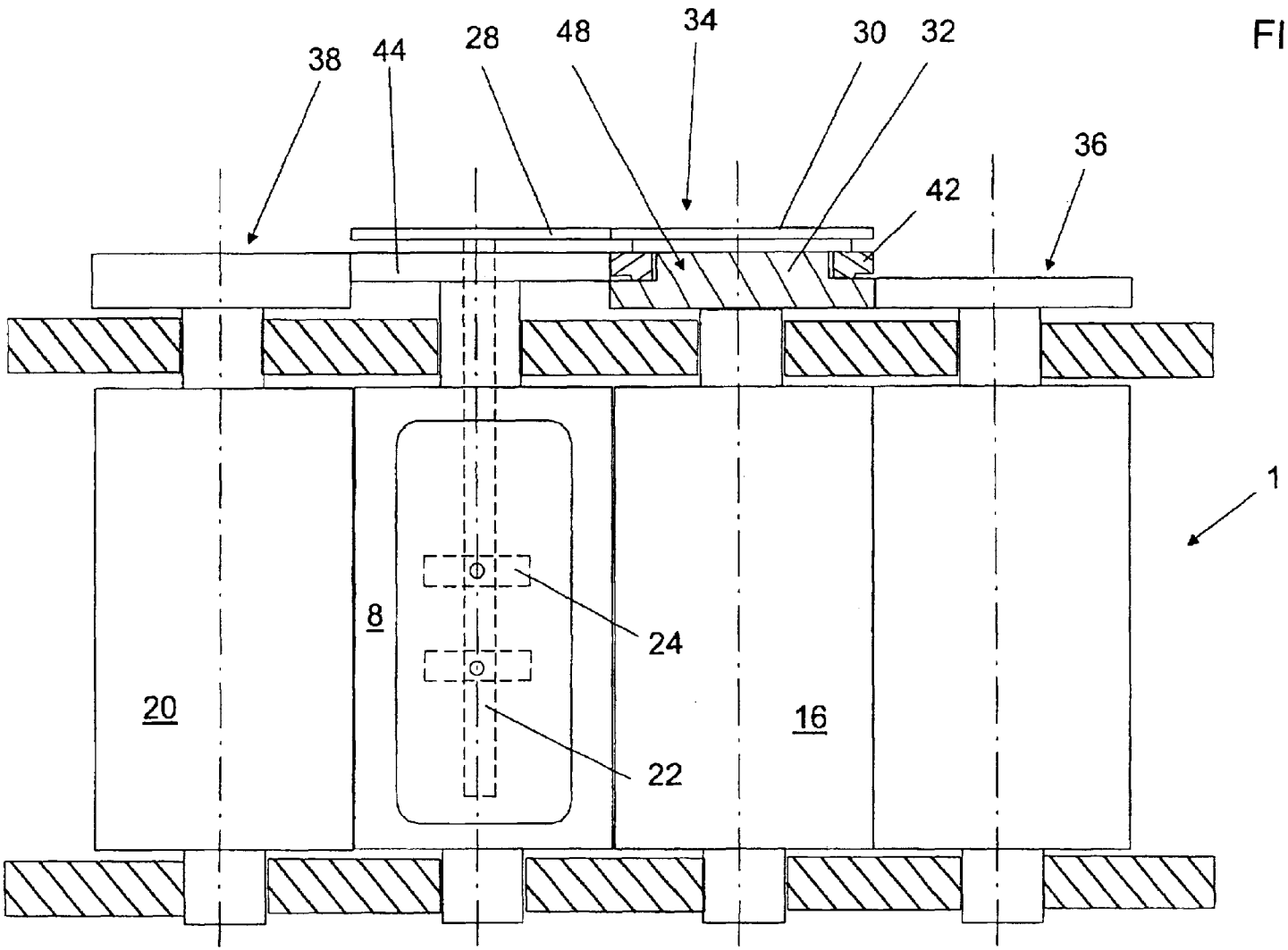
FIG. 1 is a diagrammatic, plan view, partly in section, of a first embodiment of the invention, wherein an actuating shaft is driven via a meshing gear mechanism including a first gearwheel fastened to the actuating shaft, and a second gearwheel fastened to a fixed gearwheel of a coupling for disconnecting gear trains during format changeover.
Figure 2:
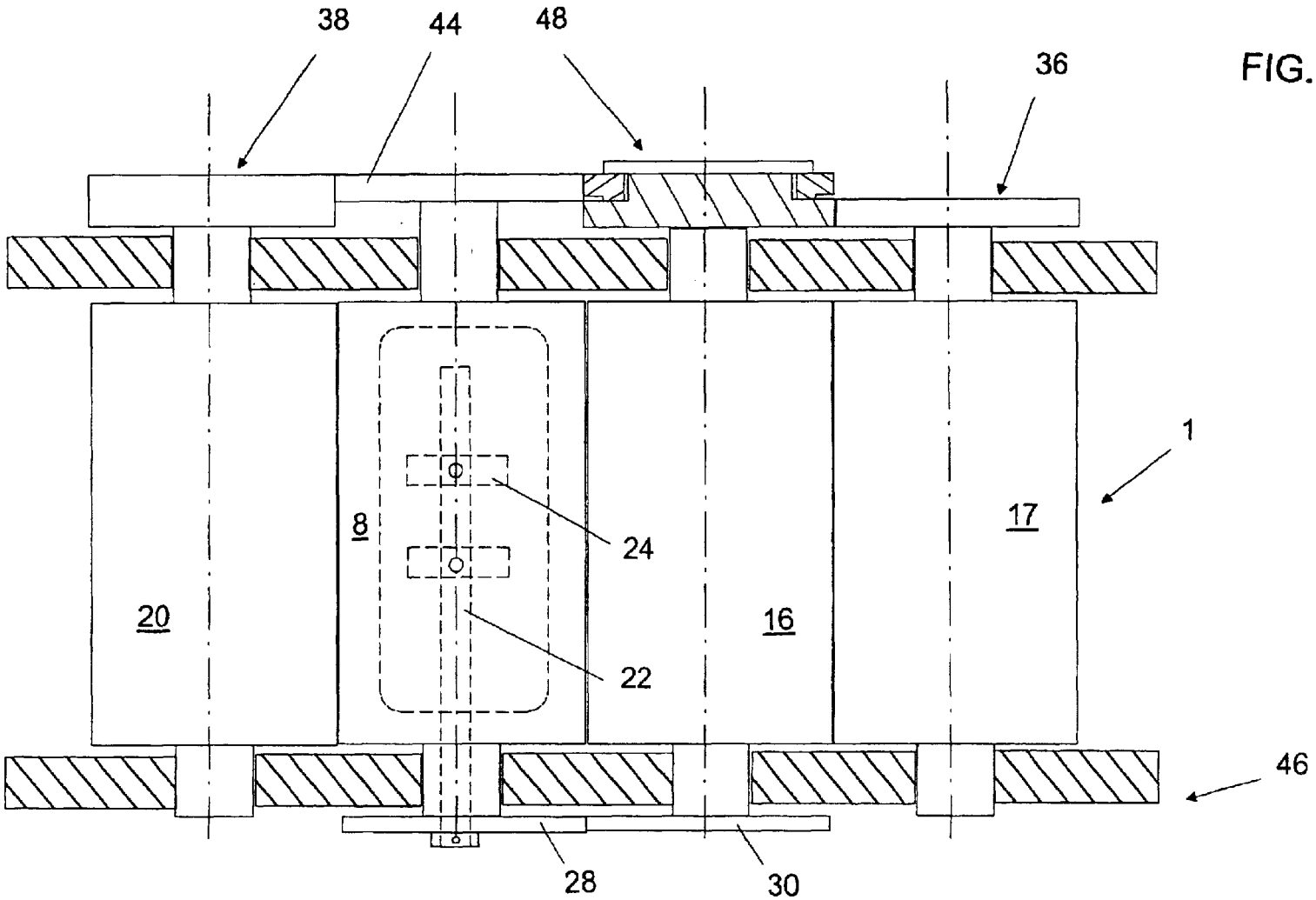
FIG. 2 is a view like that of FIG. 1 of a further embodiment of the invention, wherein the actuating shaft is rotated, from the operator side of the printing machine, via a first gearwheel coupled to the actuating shaft, and a second gearwheel driven by an upstream cylinder.
Figure 3:
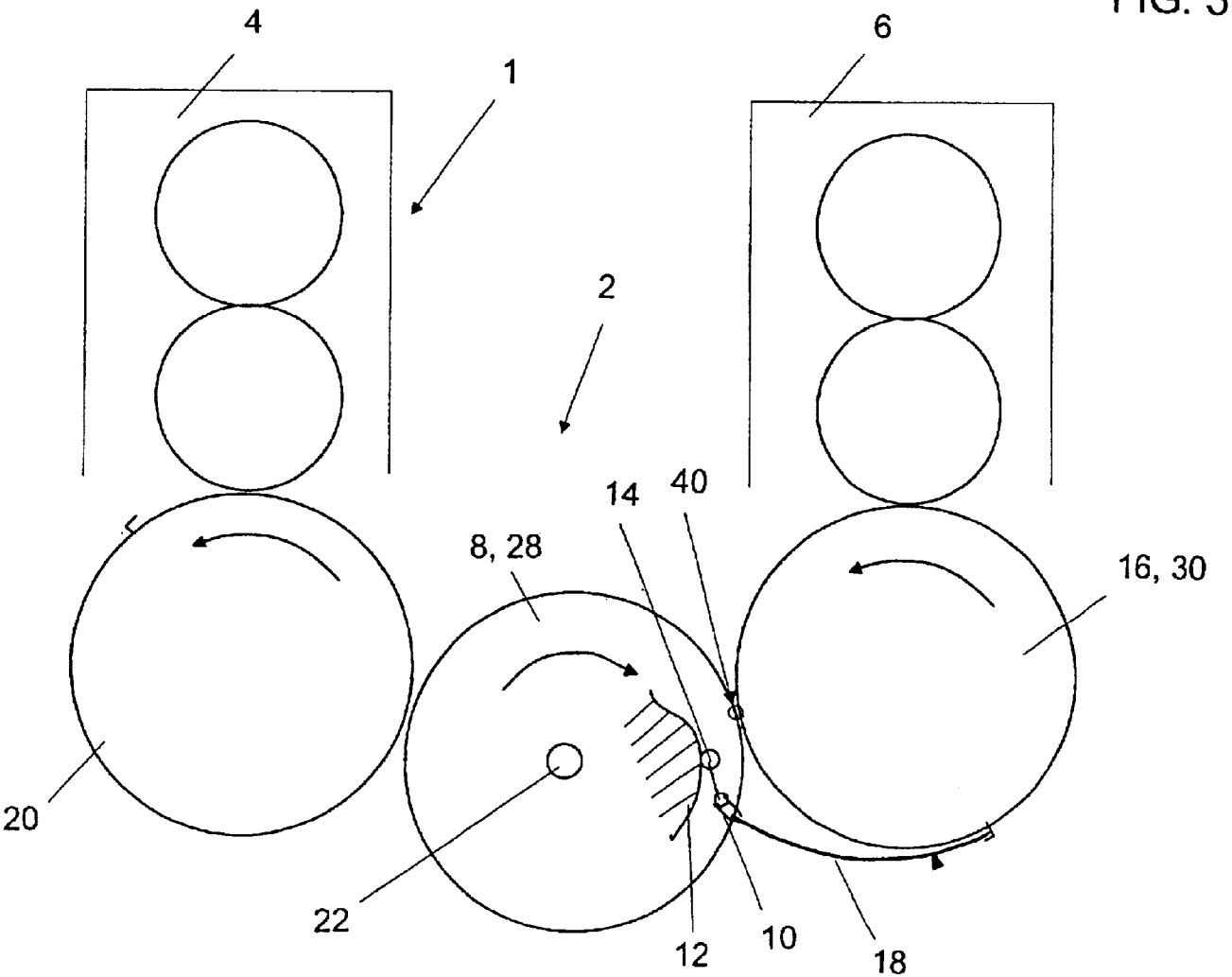
FIG. 3 is a side-elevational view of either FIG. 1 or FIG. 2 for more clearly illustrating the operative connection.

Referring now to the figures of the drawings in detail and first, particularly, to FIGS. 1 to 3 thereof, there is seen a sheet-processing machine 1 including a reversing or turning device 2 which is disposed between a first, upstream printing unit 6 for printing the upper side, and a second printing unit 4, disposed downstream of the turning configuration 2, for printing the underside, of a sheet 18 processed in the machine 1. In the case of the embodiment of the invention illustrated in the side-elevational view of FIG. 3, the reversing or turning device 2 operates in accordance with the single-drum reversing or turning principle and has a first cylinder 8, which is also referred to hereinbelow as a reversing drum, that is provided with gripping devices 10, for example pincers-type grippers or suction grippers. One or more gripper-control devices in the form of cams 12, and cam followers 14 cooperating with the cams 12, which are illustrated diagrammatically in FIG. 3, respectively open and close the gripper devices 10 and pivot them in order to grip the printed sheets 18 at the trailing edges thereof and to respectively transfer the sheets to respective gripper configurations of a downstream cylinder 20.

The gripping device 10 grips the trailing edge of a sheet 18 which has been printed on one side, and is guided on a second or further cylinder 16 of the sheet-processing machine, in particular the impression cylinder of the upstream printing unit 6. The gripping device 10 transfers the trailing edge as the new leading edge to a gripper device (illustrated without a reference numeral) of the impression cylinder 20 of the second, downstream printing unit 4, wherein the reversed or turned sheet 18 is printed, in a conventional manner, on the reverse side thereof.

Mounted preferably rotatably within the cylinder 8 is an actuating shaft 22, which extends preferably coaxially with or along the axis of rotation of the cylinder 8 and cooperates with one or more activating elements 24, via which the operating state of the gripper-control devices, which include the cams 12 and the cam followers 14, can be changed when the printing machine 1 is switched over between the single-side printing and first form and perfector printing operating states.

Figure 13:
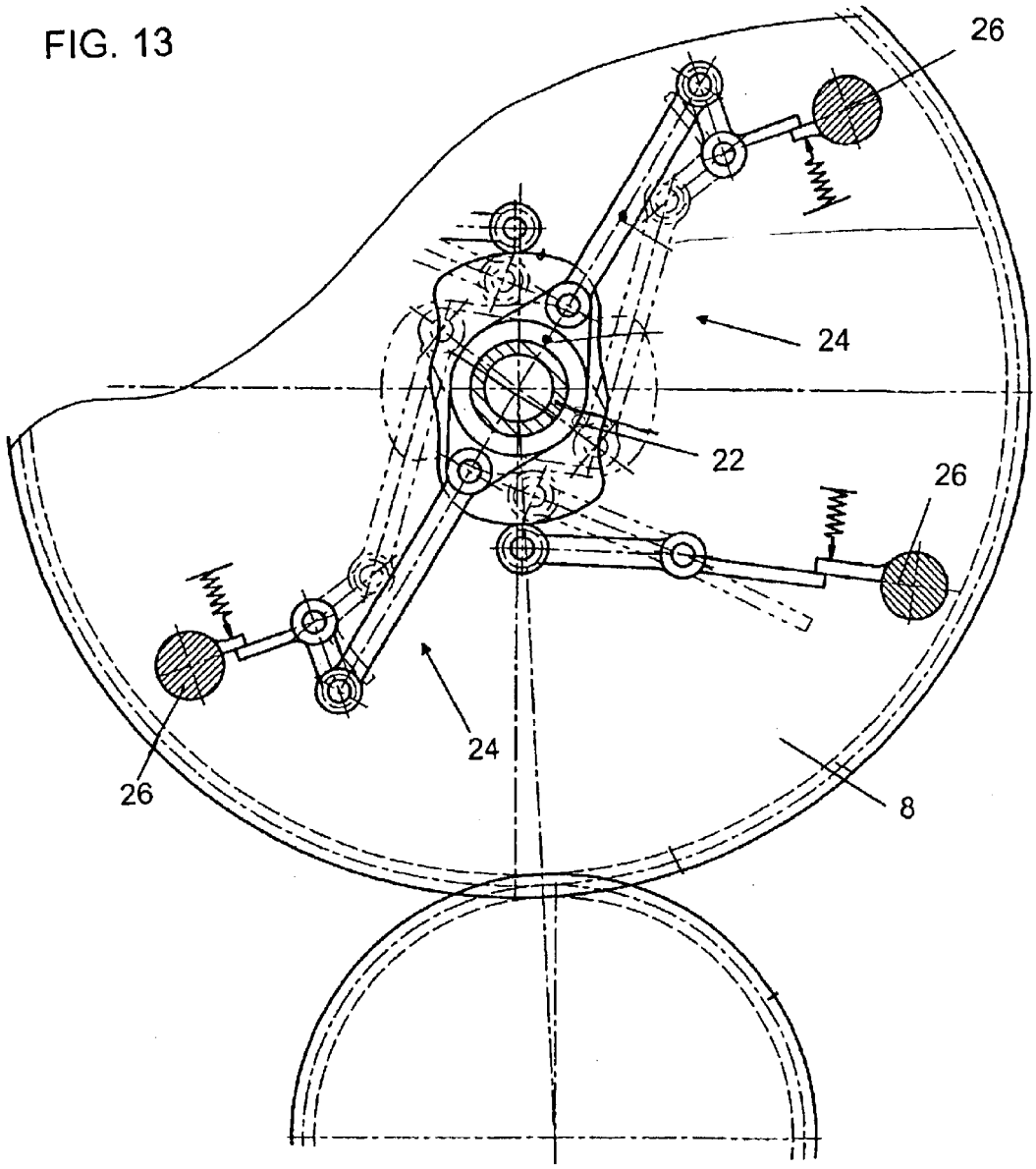
FIG. 13 is a fragmentary, side-elevational view of the cylinder with appertaining activating elements for switching over the gripper-control devices.

According to FIG. 13, the activating elements 24 may include further control cams and cam followers as well as transmission levers, which deactivate, for example, the gripper devices 10 in the single-side printing operation by bringing the appertaining gripper shafts 26 to a standstill and/or fixing them, as is shown by way of example in FIG. 13. The rotation of the actuating shaft 22 makes it possible, during the changeover from the single-side printing operation to the first form and perfector printing operation, where the deactivation of the gripper-control device to be subsequently cancelled again, which is represented in phantom in FIG. 13.

With respect to the embodiment of the invention shown in FIG. 1, an actuating element in the form of a first gearwheel 28 is fastened to the end of the actuating shaft 22. The first gearwheel is in meshing engagement with an adjusting element in the form of a second gearwheel 30.

According to the embodiment of FIG. 1, the second gearwheel 30 is disposed coaxially with the further cylinder 16 and is fastened, for example, on the end of a driving gearwheel. The fastening may take place in this case, for example, on a fixed gearwheel 32 of a coupling 34 via which the gear train 36 of the upstream printing units 6 can be decoupled from the gear train 38 of the downstream printing unit 4 for format adjustment of the reversing or turning device.

According to FIG. 3, the operative connection 40, indicated by the dot and the arrow, for driving the actuating shaft 22 is located directly between the cylinder 8 and the further cylinder 16. By the operative connection 40 between the cylinders 8 and 16, or between the first gearwheel 28 and the second gearwheel 30, the actuating shaft 22 is driven at the same rotational speed as the cylinder 8 during operation of the printing machine 1, with the result that there is no change in the angular position or setting of the actuating shaft 22, and thus the position of the activating element 24, relative to the cylinder 8 during the operation of the printing machine 1. The size of the two gearwheels 28 and 30 here corresponds at least approximately to the diameter of the cylinder 8 and of the further cylinder 16, respectively.

When a conversion or changeover of the operating state of the printing machine 1 occurs, the coupling 34 is opened, for adapting the position of the gripper device 10 to the respective sheet format, and the gear train 36 is rotated in relation to the gear train 38 until such time as the desired position of the gripper device 10 has been reached. The opening or release of the coupling 34 here preferably takes place with the aid of an adjusting gearwheel 42 which is disposed coaxially with the fixed gearwheel 32, is forced axially, via otherwise non-illustrated pressure-exerting devices, against a correspondingly formed seat of the fixed gearwheel 32, and is in meshing engagement with the driving gearwheel 44 of the cylinder 8. The fixed gearwheel 32 and the adjusting gearwheel 42 here form a double gearwheel 48.

Due to the coupling via the first gearwheel 28 and the second gearwheel 30 and due to the coupling between the second gearwheel 30 and the fixed gearwheel 32, rotation of the adjusting gearwheel 42 in relation to the fixed gearwheel 32 of the double gearwheel 48 automatically results in a corresponding rotation of the actuating shaft 22, as a result of which the operating state or operating mode of the gripper-control device 10 of the cylinder 8 changes correspondingly without requiring the printer himself or herself to be actively engaged in bringing this about.

According to the embodiment of FIG. 2, the first gearwheel 28 and the second gearwheel 30 are disposed on the operator side 46 of the printing machine, and the actuating shaft 22 extends through the operator-side drive journal of the cylinder 8 into the interior of the cylinder 8. Apart from the fact that additional space is attained on that side of the printing machine 1 of the embodiment of FIG. 2 which is located opposite the operator side 46, the embodiments of FIGS. 1 and 2 do not differ from one another in terms of function and operation.

Figure 6:
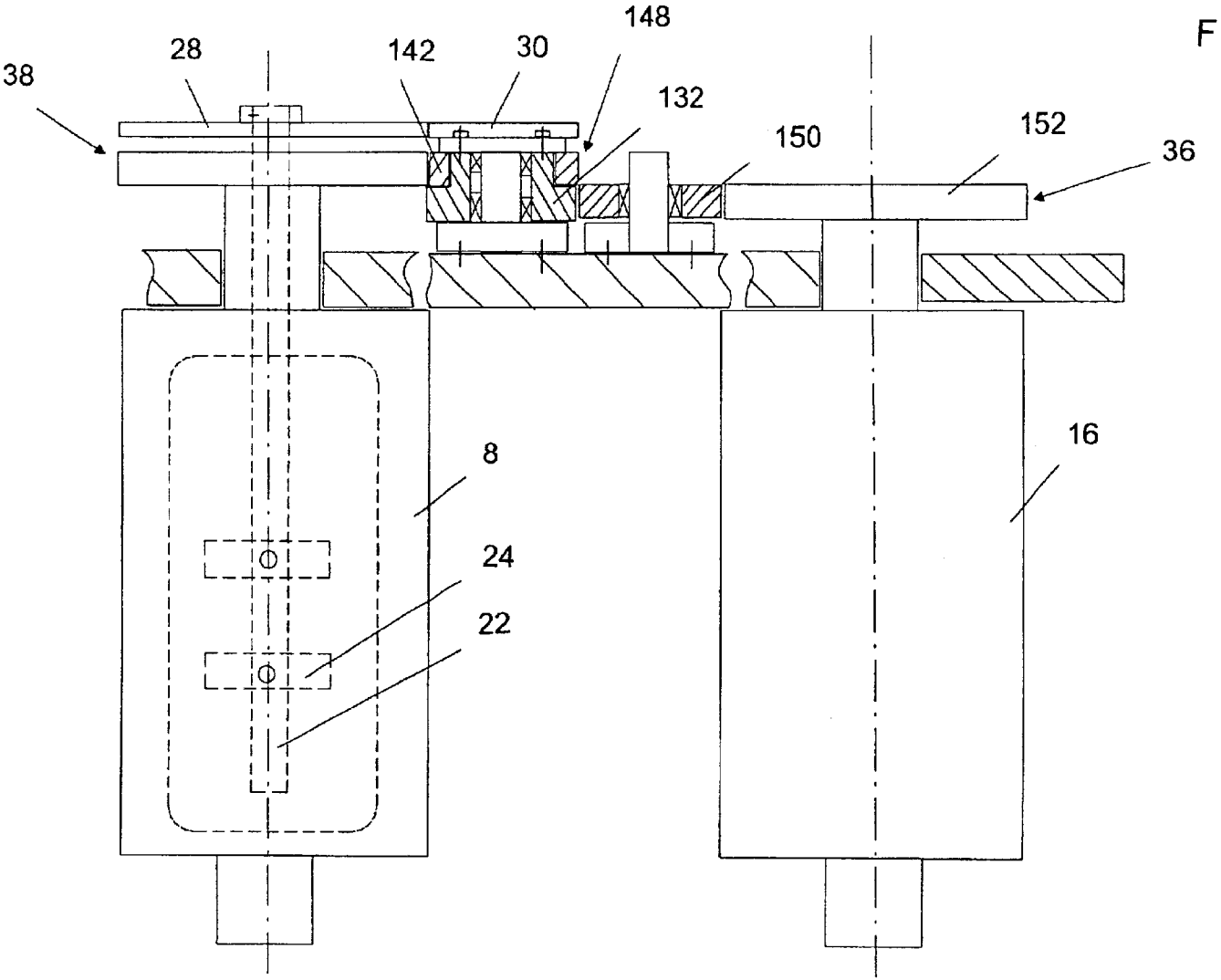
FIG. 6 is a slightly enlarged, fragmentary view similar to those of FIGS. 1, 2 and 4 of an additional embodiment of the invention, wherein the reversing or turning drum and the further cylinder are coupled via a double intermediate gearwheel revolving at an increased speed and via an intermediate gearwheel, and wherein the second gearwheel is driven via a fixed gearwheel of the double intermediate gearwheel, which is connected to the driving gearwheel of the further cylinder via a further intermediate gearwheel.
Figure 7:
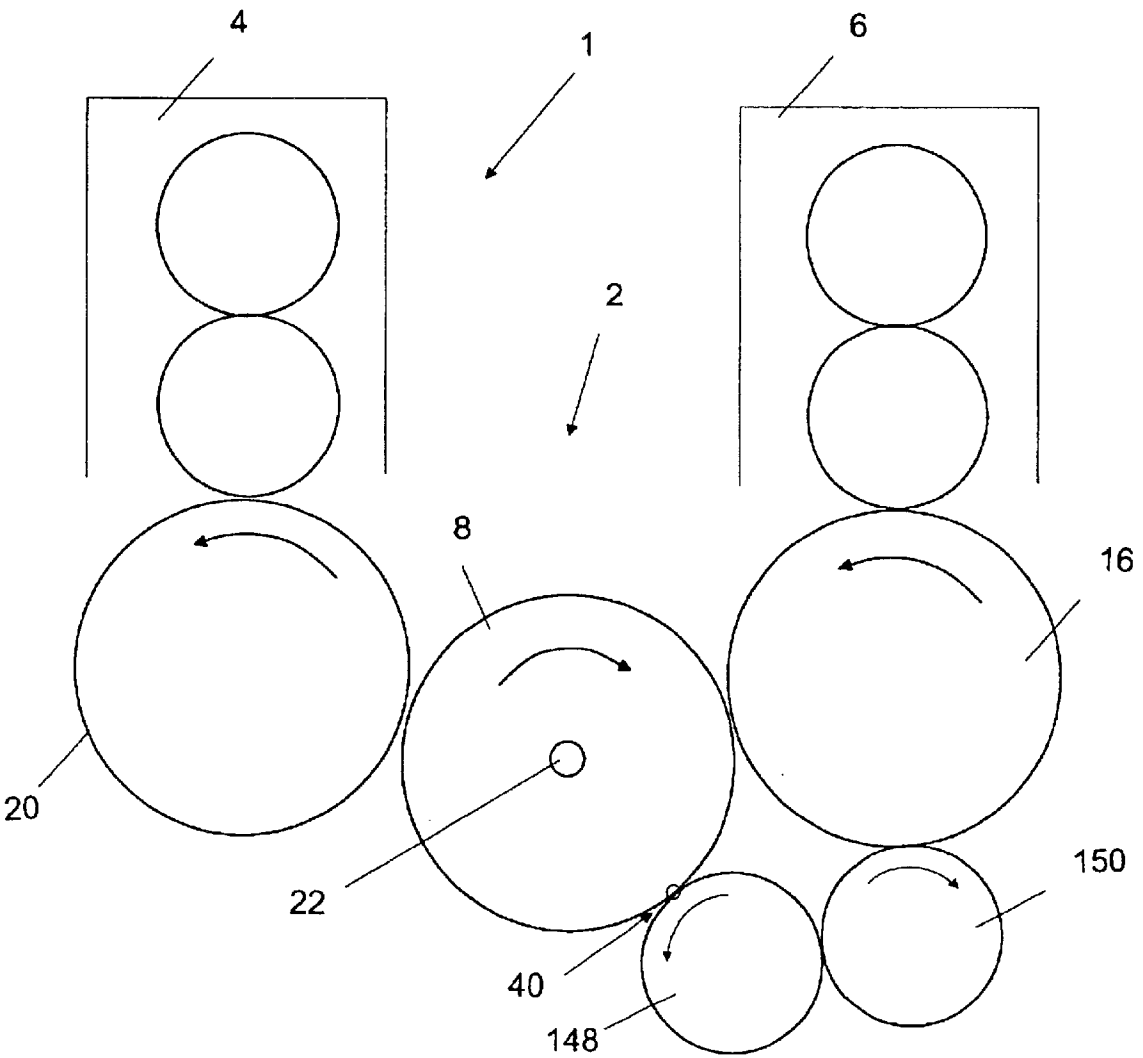
FIG. 7 is a side-elevational view of FIG. 6, showing the operative connection.

In the embodiment of the invention illustrated in FIGS. 6 and 7, and wherein the cylinder 8 and the further cylinder 16, for illustrative reasons, has been depicted as being drawn apart from one another, the releasable coupling of the gear trains 36 and 38 takes place via a double gearwheel which is formed as a double intermediate gearwheel 148 and, in the same way as the double gearwheel 48, includes an adjusting gearwheel 142 and a fixed gearwheel 132, the latter engaging, via an additional intermediate gearwheel 150, with the driving gearwheel 152 of the further, upstream impression cylinder 16. The intermediate gearwheel 150 and the double intermediate gearwheel 148 here preferably have a smaller diameter than the cylinders 8 and 16, for example, merely half the diameter, and have a correspondingly increased speed. Using the double intermediate gearwheel 148 and the intermediate gearwheel 150 provides the advantage of a considerable reduction in the tendency towards ghosting which results from the lack of roundness of the double intermediate gearwheel when use is made of a double-sized impression cylinder 16.

In the embodiment of the invention illustrated in FIG. 6, the second gearwheel 30 preferably has the same diameter as the adjusting gearwheel 142 and/or the fixed gearwheel 132, and is preferably disposed coaxially with the fixed gearwheel 132 of the double intermediate gearwheel 148, and fastened thereon.

According to FIG. 7, in the case of the previously described embodiment of the invention, the operative connection 40 for synchronously driving the actuating shaft 22 is provided between the double intermediate gearwheel 148 and the cylinder 8.

Figure 8:
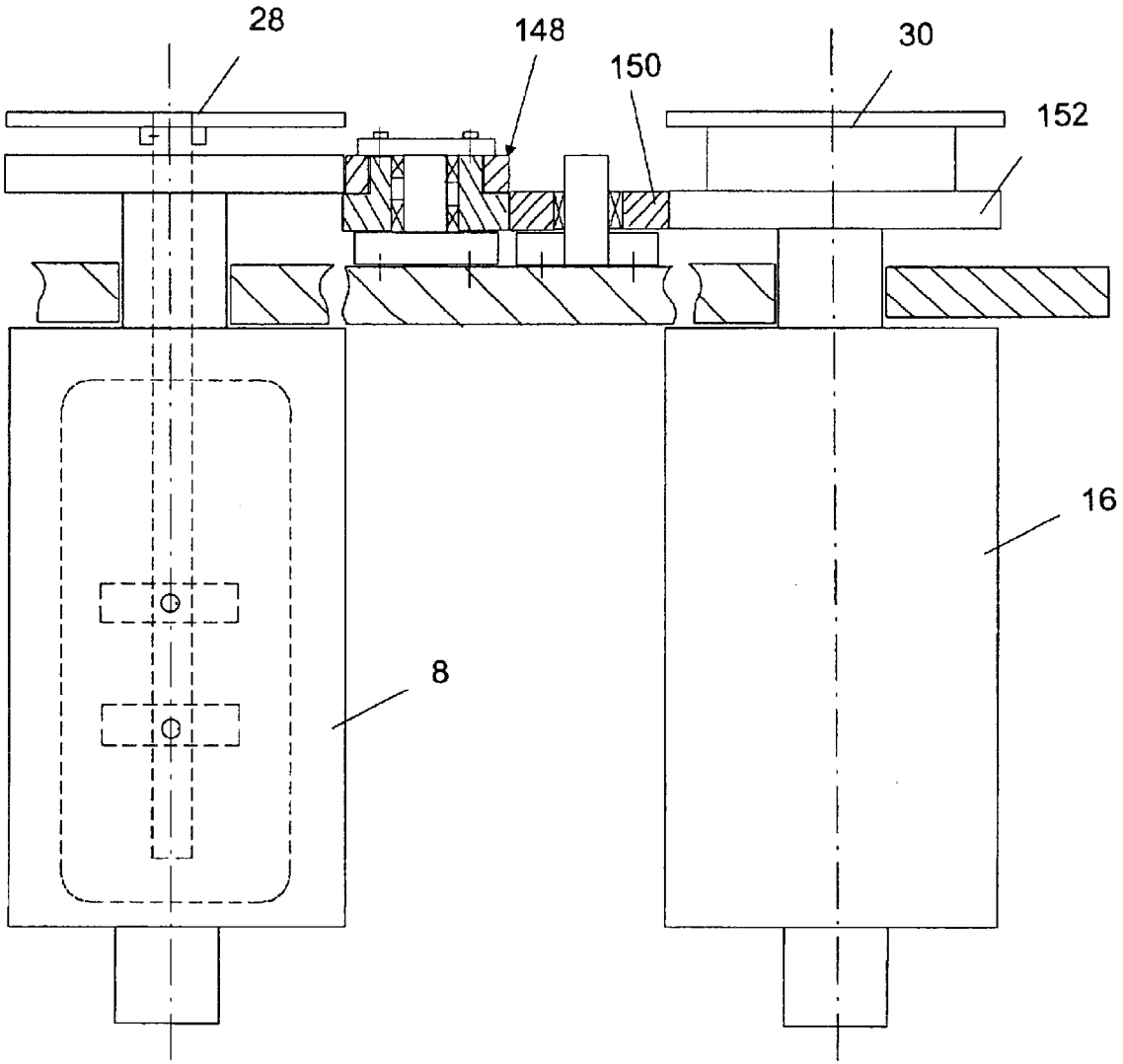
FIG. 8 is a view like that of FIG. 6, showing a further modification of the additional embodiment of FIG. 6, wherein the second gearwheel is fastened to the outside of the driving gearwheel of the further cylinder.
Figure 9:
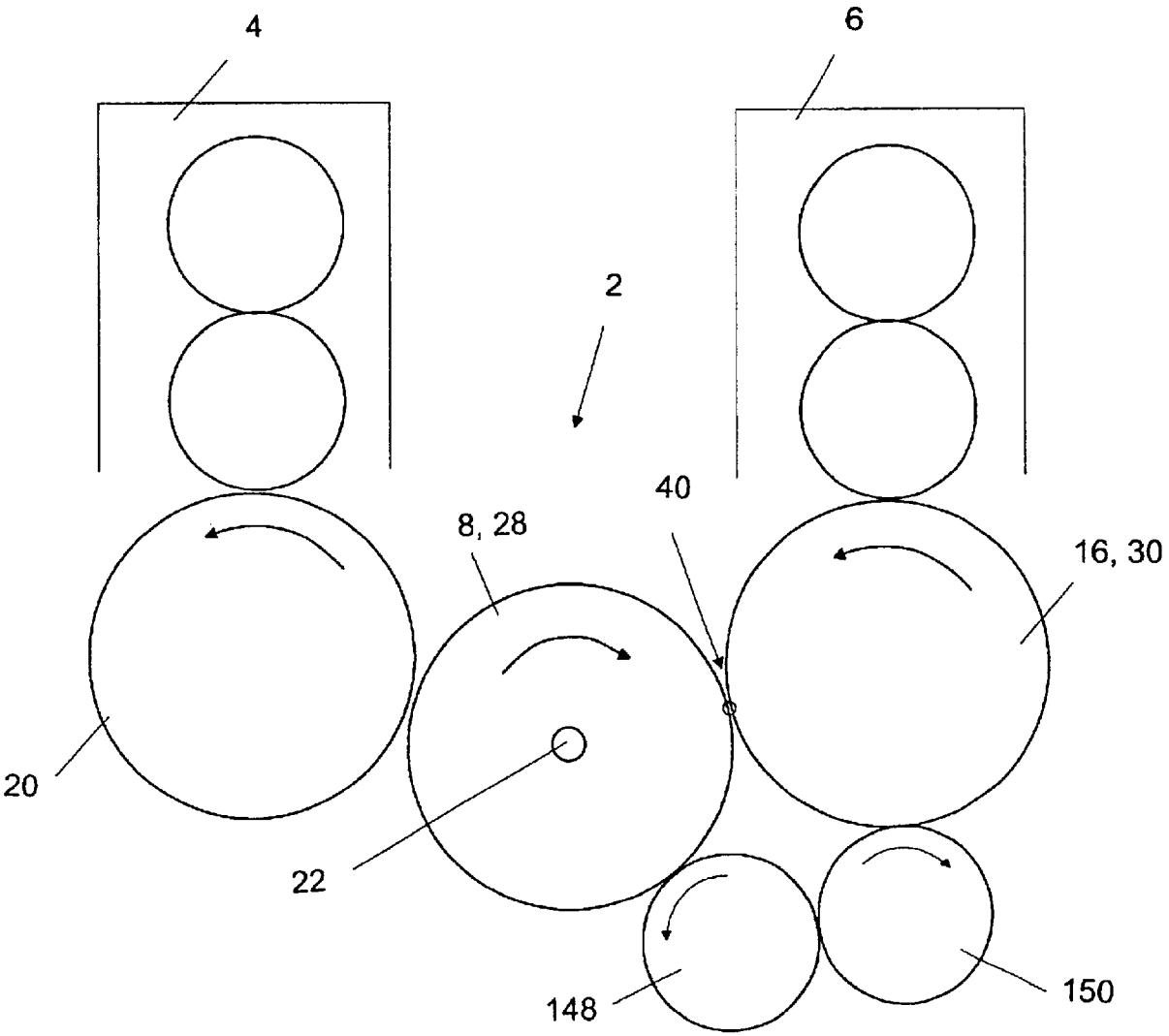
FIG. 9 is a side-elevational view of FIG. 8 with an appertaining point of interaction between the first and the second gearwheels.

In the same way, however, in the case of an embodiment of the invention which uses a double intermediate gearwheel 148 and an additional intermediate gearwheel 150, it is likewise possible for the second gearwheel 30 to be disposed coaxially with the further cylinder 16 and to be connected so as to be fixed against rotation relative thereto, for example on the driving gearwheel 152 thereof, as is shown in FIGS. 8 and 9. In this embodiment of the invention, the operative connection 40 is provided directly between the cylinder 8 and the further cylinder 16. It is produced by the meshing engagement between the first and second gearwheels 28 and 30, which have at least approximately the same diameter as the cylinders 8 and 16. In FIG. 8, the meshing engagement between the first and second gearwheels 28 and 30 cannot be seen because this is a sectional view wherein the two gearwheels are drawn apart from one another, the sectional view serving predominantly for illustrating the function of the double intermediate gearwheel 148 and of the further intermediate gearwheel 150.

Figure 4:
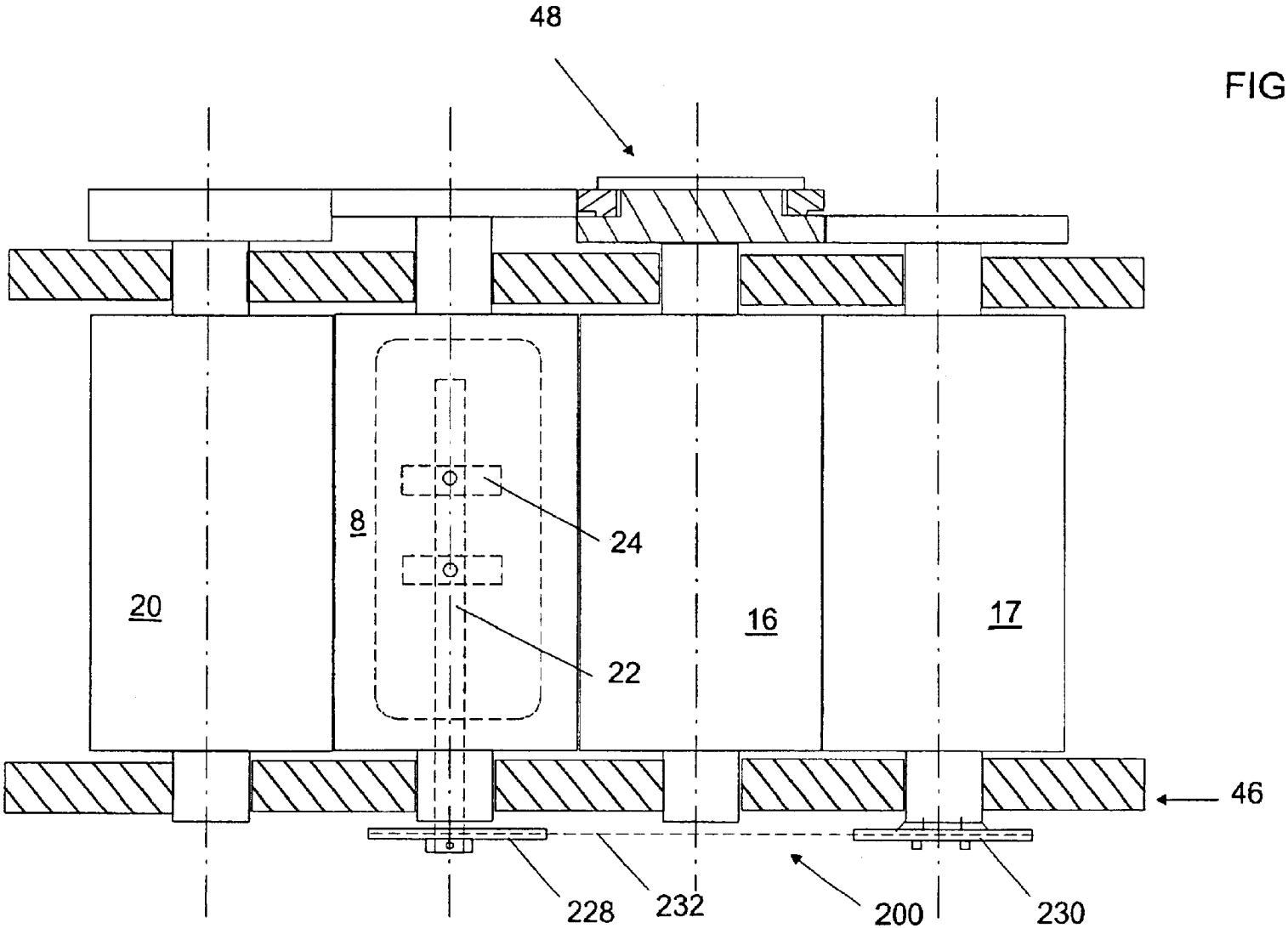
FIG. 4 is another view like those of FIGS. 1 and 2 of yet a further embodiment of the invention, wherein the movement of the actuating shaft is effected via a drawing or tensioning gear mechanism or transmission disposed on the operator side of the printing machine.
Figure 5:
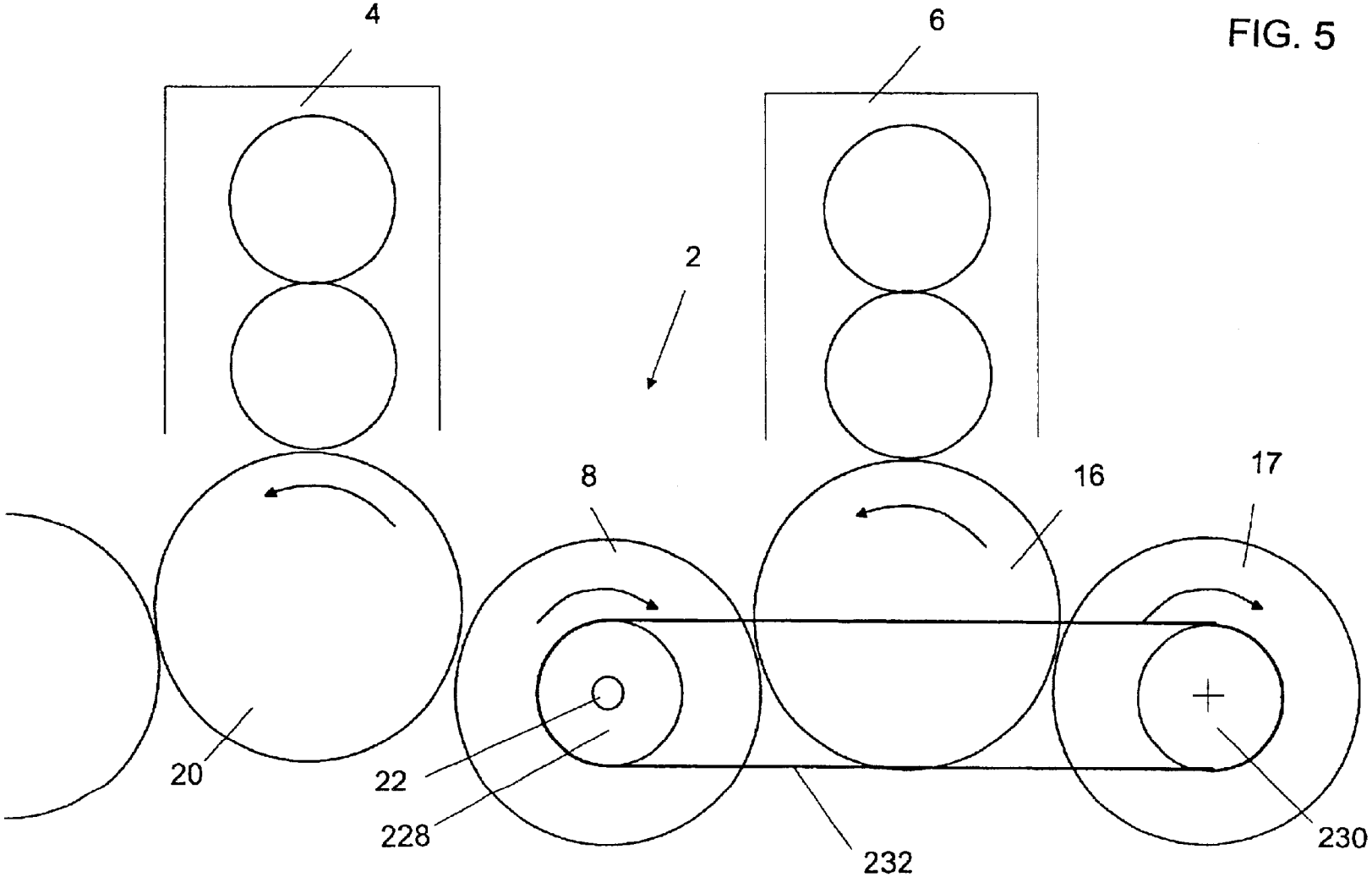
FIG. 5 is a side-elevational view of FIG. 4.

According to the embodiment of the invention shown in FIGS. 4 and 5, the actuating shaft 22 is driven synchronously with the first cylinder 8 via a tensioning or drawing gear mechanism 200 including the actuating element and the adjusting element. The tensioning gear mechanism 200 here has a first belt pulley, which forms the actuating element, or a first chain wheel 228 and a second driving belt pulley, which forms the adjusting element, or a second chain wheel 230, which, according to FIG. 4, are preferably disposed on the operator side 46 of the printing machine 1. In this embodiment of the invention, the second driving belt pulley or the second chain wheel 230 is connected to the operator-side shaft journal of a third cylinder 17, which is disposed upstream of the further cylinder 16 and may be, for example, a transfer cylinder or a transfer drum. In this embodiment of the invention using the tensioning gear mechanism 200, the operative connection 40, depending upon the configuration of the tensioning gear mechanism, is produced either via a belt, for example a toothed belt, or, if chain wheels 228 and 230 are used, via a link chain identified by reference numeral 232 in the drawings.

Figure 10:
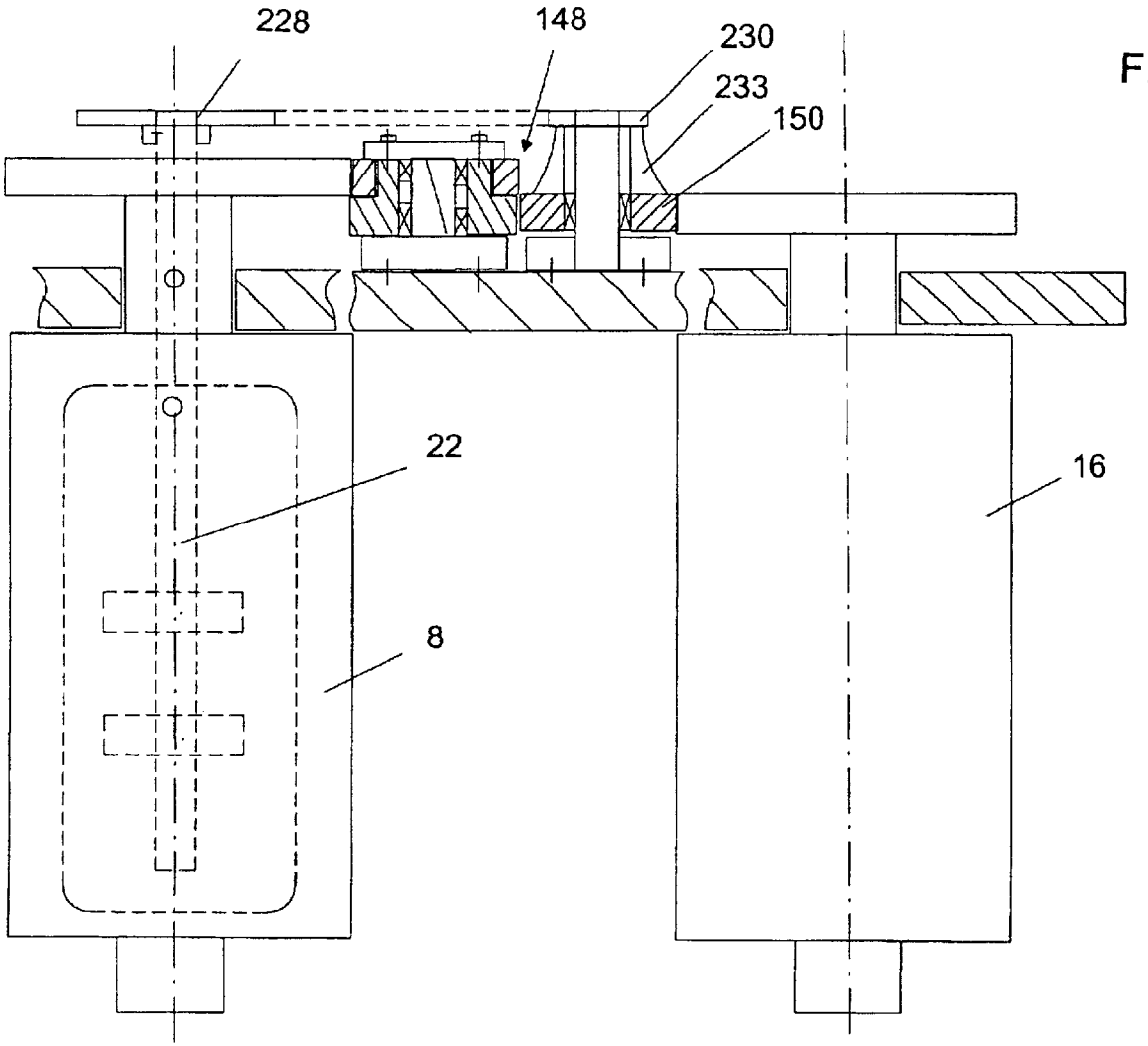
FIG. 10 is a view similar to that of FIG. 8, for example, of yet a further embodiment of the invention which uses a double intermediate gearwheel and a further intermediate gearwheel, wherein the actuating shaft is driven via a drawing or tensioning gear mechanism, a belt pulley or a chain wheel of which is fastened onto the further intermediate gearwheel.
Figure 11:
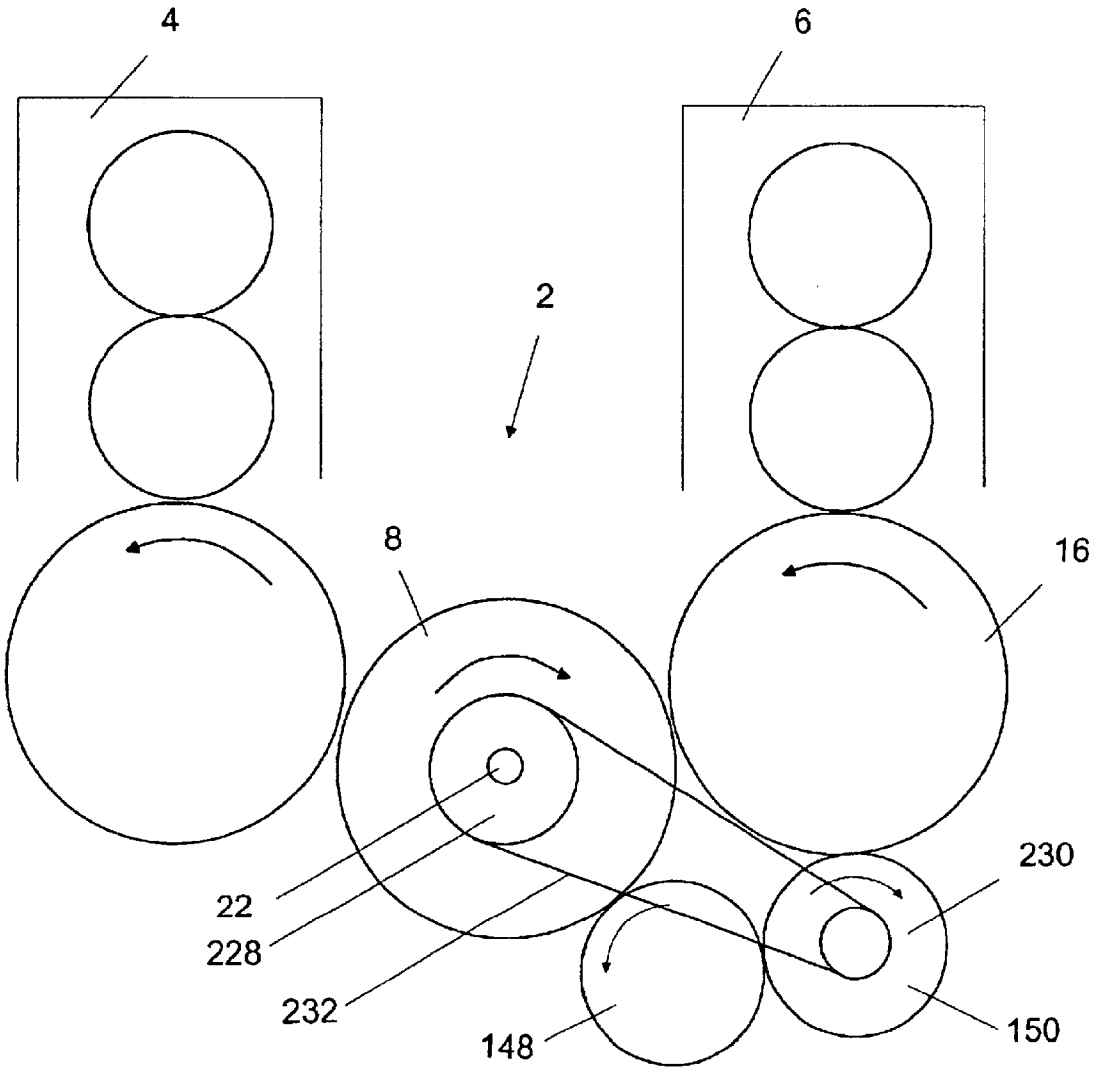
FIG. 11 is a side-elevational view of FIG. 10 wherein the drawing or tensioning gear mechanism is replaced by a belt, for example a toothed belt, or a chain.

As can further be gathered from FIGS. 10 and 11, it is also possible, in the case of this embodiment of the invention using a tensioning gear mechanism 200, for coupling of the cylinder 8 and of the further cylinder 16 to take place via a double gearwheel in the form of a double intermediate gearwheel 148 and via a further intermediate gearwheel 150 disposed upstream of the latter.

In this embodiment of the invention, the second driving belt pulley 230 and the second chain wheel 230, respectively, are preferably disposed coaxially with the further intermediate gearwheel 150 and fastened for example via a protrusion 233, formed on the further intermediate gearwheel 150, so that the tensioning or drawing device 232 runs past the double intermediate gearwheel 148 at a sufficient distance therefrom. In this case, the operative connection 40, which gives rise to the in-phase rotation of the actuating shaft 22 synchronously with the cylinder 8, takes place, via the chain and the toothed belt 232, respectively, between the further intermediate gearwheel 150 and the cylinder 8.

This embodiment of the invention and the embodiment of the invention illustrated in FIGS. 4 and 5, respectively, offer the advantage that the driving belt pulleys 228 and 230 may have a smaller diameter than the cylinders 8, 16 and/or the intermediate gearwheels 148, 150, which results in additional space being gained and costs being reduced.

Figure 12:
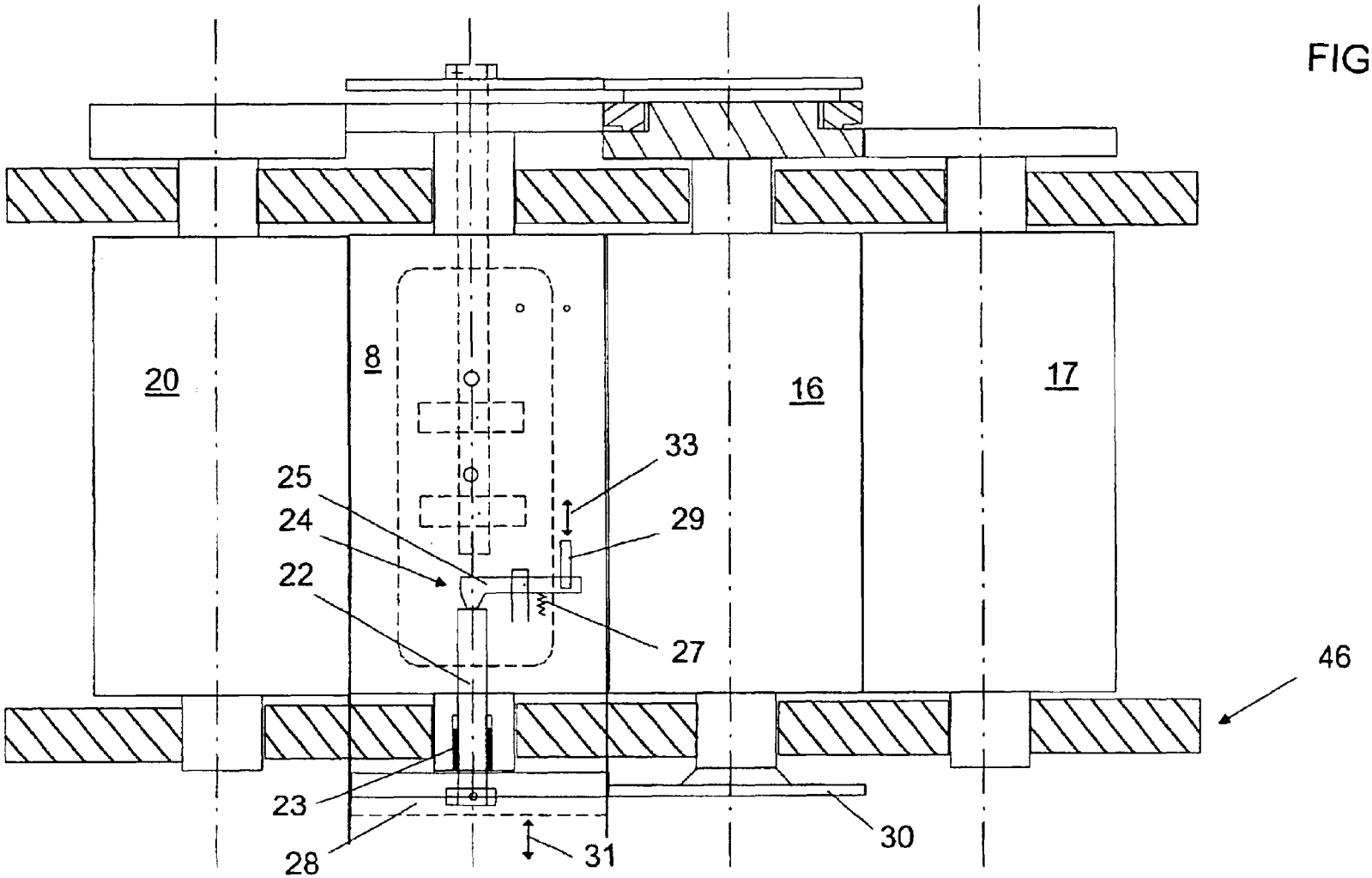
FIG. 12 is a view similar to that of FIG. 1 of still another embodiment of the invention wherein, in addition to the embodiment of FIG. 1, a further actuation shaft is disposed on the operator side, the shaft being displaceable, during rotation thereof, in the axial direction of the cylinder, via a thread formed in the journal pin of the cylinder.

As is shown, furthermore, in FIG. 12, the actuating shaft 22 may be supported on the cylinder 8 via a thread 23 so that rotation of the actuating shaft 22 relative to the cylinder 16, via the first and second gearwheels 28, 30 or via the tensioning or drawing gear mechanism 200, results in an axial movement of the actuating shaft 22, which, by the correspondingly formed activating element 24, is transmitted to the gripper-control device in order to switch over the latter in the aforedescribed manner between the different single-side printing and first form and perfector printing operating states and to carry out adaptation to different sheet formats, respectively. For this purpose, the activating element 24 may include, for example, a lever 25 which is pivotable about a point of rotation (not otherwise specifically identified) and one end of which is forced, via a resilient device 27, against the axial end surface of the actuating shaft 22. The other end of the lever 25 here is coupled to the gripper-control device, for example via a diagrammatically illustrated connecting lever element 29, so that the lever element 29 is displaced in the direction of the double arrow 33 if the first gearwheel 28 is displaced axially in the direction of the double arrow 31, via the thread 23, by being rotated relative to the cylinder 8.

This embodiment of the invention can be used either as an alternative to the embodiment of the invention illustrated in FIGS. 1 to 11 and 13, or else in addition thereto, as is illustrated in FIG. 12, in order to provide an additional manner of adjustment. The embodiment of the invention according to FIG. 12 here may be disposed both on the drive side, and on the operator side 146, of the printing machine 1.

I claim:

1. A device for changing an operating state of a gripper-control device in a sheet-reversing device of a sheet-processing machine, the sheet-reversing device including a first cylinder having an actuating shaft accommodated therein, the actuating shaft being rotatably mounted coaxially with an axis of rotation of the first cylinder, the sheet-processing machine including a second cylinder, the operating-state changing device comprising:

an activating element cooperatively engaging with the actuating shaft for changing the operating state of the gripper control device;

an actuating element coupled mechanically with the actuating shaft; and an adjusting element movable relative to the first cylinder, said adjusting element being disposed externally to the first cylinder and cooperatively engaging with said actuating element for moving said actuating element at least approximately synchronously with the first cylinder during operation of the sheet-processing machine with the actuating shaft remaining in a prescribed position with respect to the first cylinder, said adjusting element serving for changing a position of said actuating element relative to the first cylinder whenever changing the operating state;

said actuating element and said adjusting element being respective first and second mutually meshing gearwheels, said first gearwheel being connected to the actuating shaft, and said second gearwheel being in drive connection with the second cylinder of the sheet-processing machine;

said second gearwheel being disposed coaxially with the second cylinder and being connected to the second cylinder so as to be fixed against rotation relative to the second cylinder.

2. The operating-state changing device according to claim 1, wherein said first gearwheel and said second gearwheel are disposed on an operator side of the sheet-processing machine.

3. The operating-state changing device according to claim 1, wherein the first cylinder and the second cylinder are coupled with one another via a gear train having a double gearwheel including a fixed gearwheel in drive connection with the second cylinder, and an adjusting gearwheel coupled with the fixed gearwheel for forming a coupling, said coupling, when open, being rotatable relative to said fixed gearwheel for at least one of changing the mode of operation and adapting to different sheet formats.

4. A device for changing an operating state of a gripper-control device in a sheet-reversing device of a sheet-processing machine, the sheet-reversing device including a first cylinder having an actuating shaft accommodated therein, the actuating shaft being rotatably mounted coaxially with an axis of rotation of the first cylinder, the sheet-processing machine including a second cylinder, the operating-state changing device comprising:

an activating element cooperatively engaging with the actuating shaft for changing the operating state of the gripper control device;

an actuating element coupled mechanically with the actuating shaft; and an adjusting element movable relative to the first cylinder, said adjusting element being disposed externally to the first cylinder and cooperatively engaging with said actuating element for moving said actuating element at least approximately synchronously with the first cylinder during operation of the sheet-processing machine with the actuating shaft remaining in a prescribed position with respect to the first cylinder, said adjusting element serving for changing a position of said actuating element relative to the first cylinder whenever changing the operating state;

said actuating element and said adjusting element being respective first and second mutually meshing gearwheels, said first gearwheel being connected to the actuating shaft, and said second gearwheel being in drive connection with the second cylinder of the sheet-processing machine;

the first cylinder and the second cylinder being coupled with one another via a gear train having a double gearwheel including a fixed gearwheel in drive connection with the second cylinder, and an adjusting gearwheel coupled with the fixed gearwheel for forming a coupling, said coupling, when open, being rotatable relative to said fixed gearwheel for at least one of changing the mode of operation and adapting to different sheet formats;

said fixed gearwheel being disposed coaxially with the second cylinder and being connected to the second cylinder so as to be fixed against rotation relative to the second cylinder, and said second gearwheel being disposed coaxially with said fixed gearwheel and being connected to the fixed gearwheel so as to be fixed against rotation relative to the fixed gearwheel.

5. The operating-state changing device according to claim 3, wherein said double gearwheel is a double intermediate gearwheel for revolving at a greater speed than the first cylinder, said double intermediate gearwheel being in drive connection with a driving gearwheel of the second cylinder via a further intermediate gearwheel, said second gearwheel being disposed coaxially with said fixed gearwheel of said double intermediate gearwheel and being connected thereto so as to be fixed against rotation relative thereto.

6. A device for changing an operating state of a gripper-control device in a sheet-reversing device of a sheet-processing machine, the sheet-reversing device including a first cylinder having an actuating shaft accommodated therein, the actuating shaft being rotatably mounted coaxially with an axis of rotation of the first cylinder, the sheet-processing machine including a second cylinder, the operating-state changing device comprising:

an activating element cooperatively engaging with the actuating shaft for changing the operating state of the gripper control device;

an actuating element coupled mechanically with the actuating shaft; and an adjusting element movable relative to the first cylinder, said adjusting element being disposed externally to the first cylinder and cooperatively engaging with said actuating element for moving said actuating element at least approximately synchronously with the first cylinder during operation of the sheet-processing machine with the actuating shaft remaining in a prescribed position with respect to the first cylinder, said adjusting element serving for changing a position of said actuating element relative to the first cylinder whenever changing the operating state; a tensioning gear mechanism including said actuating element and said adjusting element, the actuating shaft being drivable via said tensioning gear mechanism by the second cylinder, said actuating element being one of a first belt pulley connected to the actuating shaft and a first chain wheel, and said adjusting element being one of a second belt pulley in drive connection with the second cylinder and a second chain wheel.

7. The operating-state changing device according to claim 6, wherein said one of said second belt pulley and said second chain wheel disposed coaxially with a third cylinder disposed directly upstream of the second cylinder and is connected thereto so as to be fixed against rotation relative thereto.

8. The operating-state changing device according to claim 6, wherein said tensioning gear mechanism is disposed on an operator side of the sheet-processing machine.

9. The operating-state changing device according to claim 6, wherein the first cylinder and the second cylinder are coupled with one another via a gear train having a double gearwheel including a fixed gear wheel in drive connection with the second cylinder and an adjusting gearwheel coupled with said fixed gearwheel for forming a coupling, said coupling, when open, being rotatable with respect to said fixed gearwheel for changing one of the operating mode and the adaptation to different sheet formats, said double gearwheel being a double intermediate gearwheel for revolving at a greater speed than the first cylinder and being in drive connection with the driving gearwheel of the second cylinder via a further intermediate gearwheel, and one of said second belt pulley and said second chain wheel being disposed coaxially with the further intermediate gearwheel and being connected thereto so as to be fixed against rotation relative thereto.

10. A device for changing an operating state of a gripper-control device in a sheet-reversing device of a sheet-processing machine, the sheet-reversing device including a cylinder having an actuating shaft accommodated therein, the operating-state changing device comprising:

an activating element cooperatively engaging with the actuating shaft for changing the operating state of the gripper control device;

an actuating element coupled mechanically with the actuating shaft; and an adjusting element movable relative to the cylinder, said adjusting element being disposed externally to the cylinder and cooperatively engaging with said actuating element for moving said actuating element at least approximately synchronously with the cylinder during operation of the sheet-processing machine with the actuating shaft remaining in a prescribed position with respect to the cylinder, said adjusting element serving for changing a position of said actuating element relative to the cylinder whenever chancing the operating state;

the operating state of gripper control device being changed by switching-over the gripper-control device between single-side printing and first form and perfector printing, and the actuating shaft being supported relative to the cylinder via a thread for producing an axial movement of the actuating shaft when the actuating shaft is rotated relative to the cylinder, said activating element including a lever for transmitting the axial movement of the actuating shaft to the gripper-control device for switching-over the gripper-control device between one of single-side printing and first form and perfector printing operating states and adapting the gripper-control device for different sheet formats.

11. The operating-state changing device according to claim 1, wherein the first cylinder is a reversing drum of the sheet-reversing device.

12. The operating-state changing device according to claim 1, wherein the second cylinder is an impression cylinder of the sheet-processing machine, and the impression cylinder is disposed upstream of the sheet-reversing device.

13. The operating-state changing device according to claim 1, wherein said adjusting element is in permanent engagement with said actuating element.

14. The operating-state changing device according to claim 1, wherein the operating state of the gripper control device is changed by switching-over the gripper-control device between single-side printing and first form and perfector printing.

15. A sheet-processing machine, comprising:

a sheet-reversing device having a gripper-control device and a first cylinder with an actuating shaft accommodated therein, said actuating shaft being rotatably mounted coaxially with an axis of rotation of said first cylinder, the sheet-processing machine having a second cylinder; and a device for changing an operating state of said gripper-control device, said operating state changing device including:

an activating element cooperatively engaging with said actuating shaft for changing the operating state of said gripper-control device;

an actuating element coupled mechanically with said actuating shaft; and an adjusting element movable relative to said first cylinder, said adjusting element being disposed externally to said first cylinder and cooperatively engaging with said actuating element for moving said actuating element at least approximately synchronously with said first cylinder during operation of the sheet-processing machine with said actuating shaft remaining in a prescribed position with respect to said first cylinder, said adjusting element serving for changing a position of said actuating element relative to said first cylinder whenever changing the operating state;

said actuating element and said adjusting element being respective first and second mutually meshing gearwheels, said first gearwheel being connected to said actuating shaft, and said second gearwheel being in drive connection with said second cylinder of the sheet-processing machine;

said second gearwheel being disposed coaxially with said second cylinder and being connected to the second cylinder so as to be fixed against rotation relative to the second cylinder.

16. A sheet-fed rotary printing press, comprising:

a sheet-reversing device having a gripper-control device and a first cylinder with an actuating shaft accommodated therein, said actuating shaft being rotatably mounted coaxially with an axis of rotation of the first cylinder, the sheet-fed rotary printing press having a second cylinder; and a device for changing an operating state of said gripper-control device, said operating state changing device including:

an activating element cooperatively engaging with said actuating shaft for changing the operating state of said gripper-control device;

an actuating element coupled mechanically with said actuating shaft; and an adjusting element movable relative to said first cylinder, said adjusting element being disposed externally to said first cylinder and cooperatively engaging with said actuating element for moving said actuating element at least approximately synchronously with said first cylinder during operation of the printing press with said actuating shaft remaining in a prescribed position with respect to said first cylinder, said adjusting element serving for changing a position of said actuating, element relative to said first cylinder whenever changing the operating state;

said actuating element and said adjusting element being respective first and second mutually meshing gearwheels, said first gearwheel being connected to said actuating shaft, and said second gearwheel being in drive connection with said second cylinder of the sheet-processing machine;

said second gearwheel being disposed coaxially with said second cylinder and being connected to the second cylinder so as to be fixed against rotation relative to the second cylinder.

* * * * *